US009975330B1

(12) United States Patent
Metcalfe et al.

(10) Patent No.: US 9,975,330 B1
(45) Date of Patent: May 22, 2018

(54) SYSTEM AND METHOD FOR GENERATION OF NON-FIRING ELECTRICAL SIGNALS FOR OPERATION OF EJECTORS IN INKJET PRINTHEADS

(71) Applicant: Xerox Corporation, Norwalk, CT (US)

(72) Inventors: David J. Metcalfe, Marion, NY (US); Douglas D. Darling, Portland, OR (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 15/489,390

(22) Filed: Apr. 17, 2017

(51) Int. Cl.
*B41J 2/045* (2006.01)

(52) U.S. Cl.
CPC ..... *B41J 2/04536* (2013.01); *B41J 2/04581* (2013.01)

(58) Field of Classification Search
CPC ..... B41J 2/04536; B41J 2/04581
See application file for complete search history.

(56) References Cited

U.S. PATENT DOCUMENTS 5,107,276 A 4/1992 Kneezel et al.
5,903,286 A 5/1999 Takahashi
6,099,103 A 8/2000 Takahashi
6,186,610 B1 2/2001 Kocher et al.
6,305,773 B1 10/2001 Burr et al.
6,312,080 B1 11/2001 De Roos et al.
6,354,686 B1 3/2002 Tanaka et al.
6,422,677 B1 7/2002 Deshpande et al.
6,450,609 B1 9/2002 Premnath et al.
6,499,821 B1 * 12/2002 Nozawa ..... B41J 2/04503 347/14
7,021,733 B2 4/2006 Darling
8,403,440 B2 3/2013 Williams et al.
2001/0022596 A1 9/2001 Korol
2004/0085374 A1 5/2004 Berger et al.
2006/0055715 A1 * 3/2006 Nakahara ..... B41J 2/04528 347/5
2006/0082608 A1 4/2006 Berger et al.
2010/0141697 A1 6/2010 Berger et al.
2010/0201725 A1 8/2010 Williams et al.

* cited by examiner

*Primary Examiner* — Lamson Nguyen
(74) *Attorney, Agent, or Firm* — Maginot, Moore & Beck, LLP

(57) ABSTRACT

A method for operating an inkjet printhead includes identifying a number of ink drop ejections for an inkjet in the printhead to form a printed image with reference to image data corresponding to the printed image and generating control data that specify a sequence of a plurality of non-firing electrical signals to be applied to the inkjet with reference to a predetermined control sequence stored in a memory and the number of ink drop ejections. The method further includes generating non-firing electrical signals applied to the inkjet with reference to the control data and generating a plurality of firing electrical signals applied to the inkjet to eject ink drops after generating every non-firing electrical signal in the plurality of non-firing electrical signals.

15 Claims, 6 Drawing Sheets

SYSTEM AND METHOD FOR GENERATION OF NON-FIRING ELECTRICAL SIGNALS FOR OPERATION OF EJECTORS IN INKJET PRINTHEADS

TECHNICAL FIELD

This disclosure is directed to inkjet printheads used in printers and additive manufacturing systems and, more particularly, to systems and methods for generating non-firing signals prior to improve the subsequent operation of inkjets in the printhead.

BACKGROUND

Inkjet printers employ printheads in a wide range of applications to form printed documents and, more recently, have found new uses in various types of manufacturing including additive manufacturing systems that are popularly referred to as "3D printers". Modern inkjet printheads are complex microfluidic devices that often include hundreds or thousands of inkjets, each of which emits drops of ink at precise times in response to firing electrical signals to form high-quality printed images or manufactured articles. The failure of one or more inkjets to eject ink drops during operation of the printhead may negatively impact the quality of printed documents and manufactured articles.

One method that is known to the art that can improve the reliability of inkjet operation in an inkjet printhead is to apply a non-firing electrical signal (also referred to as a "pre-firing" electrical signal) to the inkjets in a short time prior to operating the printhead to eject ink drops. The non-firing electrical signals do not actually eject ink drops from the inkjets, but the inkjets agitate the ink within the microfluidic channels of the printhead in response to the non-firing electrical signals. The agitation produces positive effects in the reliability of the inkjets during subsequent ink drop ejection operations that occur shortly after the inkjets receive the non-firing electrical signals. After long delays without either operation of the inkjet or a purge operation that clears ink from the inkjet, the first few firing cycles from the previously idle inkjet often experience a failure to eject ink drops. In other situations, the inkjet experiences a delay in ejecting the first few ink drops after being idle or the inkjet ejects ink drops with a smaller than normal size. With subsequent firing cycles the drops eventually reach normal velocities and size. The non-firing signals can eliminate the transient deficiencies in drop formation from the idle inkjets.

The application of non-firing signals to inkjets, however, also presents drawbacks that can actually reduce the reliability of the inkjets. For example, if an inkjet receives one or more non-firing signals but does not actually eject drops within a comparatively short time (e.g. within 10-20 seconds), then the non-firing signals may precipitate evaporation and drying of the ink within the inkjet, which produces a clogged inkjet that reduces the reliability of the printhead. In many complex printing operations, a single printhead may use a portion of the inkjets in the printhead to eject ink drops, but a significant portion of the inkjets may remain inactive for a relatively long period only to be required at a later time during a printing operation. Thus, the application of the non-firing electrical signals to the inkjets in a printhead may produce inconsistent results for the printhead since some inkjets may experience improved performance while other inkjets experience degraded performance. Consequently, improvements to inkjet printers that employ non-firing electrical signals to reduce or eliminate these negative effects upon inkjet operation would be beneficial.

SUMMARY

In one embodiment, a method for operating a printhead in a printer has been developed. The method includes identifying, with a controller, a first number of ink drop ejections for a first inkjet in a plurality of inkjets in the printhead to form a first portion of a printed image with reference to image data corresponding to the printed image prior to operation of the printhead to form the printed image, generating, with the controller, first control data that specify a sequence of a plurality of non-firing electrical signals to be applied to an actuator in the first inkjet with reference to a first predetermined control sequence stored in a memory of the printer and the first number of ink drop ejections, the first control data including at least one fewer generation of the plurality of non-firing electrical signals than specified in the first predetermined control sequence, generating, with the controller and an electrical signal generator, a first plurality of non-firing electrical signals applied to the actuator in the first inkjet with reference to the first control data, and generating, with the controller and the electrical signal generator, a first plurality of firing electrical signals applied to the actuator in the first inkjet to eject ink drops from the printhead with reference to the image data, the first plurality of firing electrical signals being generated after the generating of every non-firing electrical signal in the first plurality of non-firing electrical signals.

In another embodiment, a method for operating a printhead in a printer has been developed. The method includes identifying, with a controller, a first number of ink drop ejections for a first inkjet in a plurality of inkjets in the printhead to form a portion of a printed image with reference to image data corresponding to the printed image prior to operation of the printhead to form the printed image, generating, with the controller and an electrical signal generator, a first plurality of non-firing electrical signals applied to an actuator in the first inkjet, the first plurality of non-firing electrical signals including a first number of non-firing electrical signals corresponding to the first number of ink drop ejections, and generating, with the controller and the electrical signal generator, a first plurality of firing electrical signals applied to the actuator in the first inkjet to eject ink drops from the printhead with reference to the image data, the first plurality of firing electrical signals being generated after generating every non-firing electrical signal in the first plurality of non-firing electrical signals.

In another embodiment, a printer that includes a printhead has been developed. The printer includes a printhead including a plurality of inkjets, an electrical signal generator operatively connected to the plurality of inkjets in the printhead, an image receiving member, a memory, and a controller operatively connected to the electrical signal generator and the memory. The controller is configured to identify a first number of ink drop ejections for a first inkjet in the plurality of inkjets in the printhead to form a first portion of a printed image prior to operation of the printhead to form the printed image with reference to image data corresponding to the printed image stored in the memory, generate first control data that specify a sequence of a plurality of non-firing electrical signals to be applied to an actuator in the first inkjet with reference to a first predetermined control sequence stored in the memory and the first number of ink drop ejections, the first control data including at least one fewer generation of the plurality of non-firing electrical signals than specified in the first predetermined control sequence, generate a first plurality of non-firing electrical signals with the electrical signal generator with reference to the first control data, the first plurality of non-firing electrical signals being applied to the actuator in the first inkjet, and generate a first plurality of firing electrical signals with the electrical signal generator with reference to the image data, the first plurality of firing electrical signals being applied to the actuator in the first inkjet to eject ink drops from the printhead onto a surface of the image receiving member with reference to the image data, the first plurality of firing electrical signals being generated after the generation of every non-firing electrical signal in the first plurality of non-firing electrical signals.

BRIEF DESCRIPTION OF THE DRAWINGS

The foregoing aspects and other features of inkjet printheads and method of operating the inkjet printheads are explained in the following description, taken in connection with the accompanying drawings.

DETAILED DESCRIPTION

Figure 1:
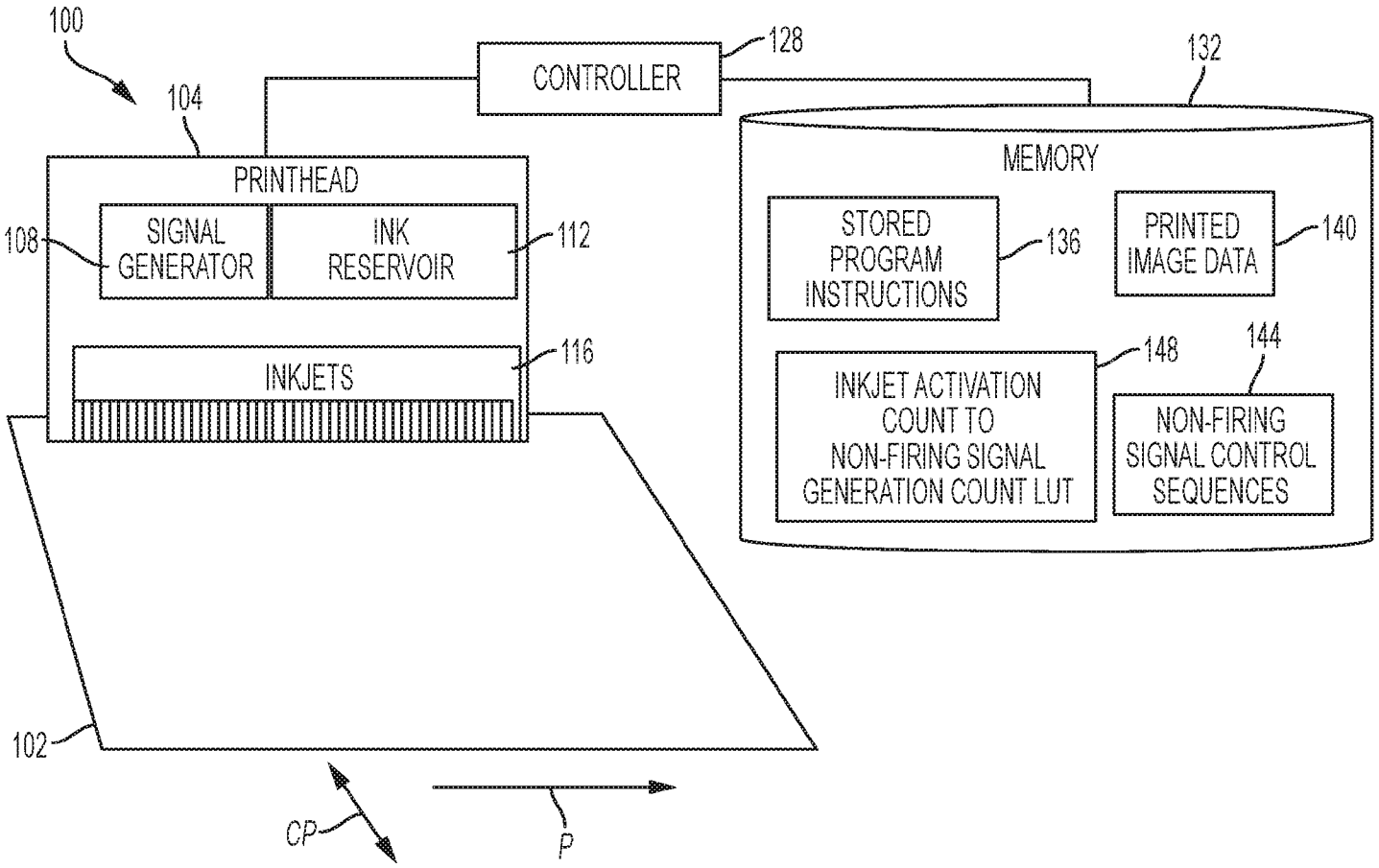
FIG. 1 is a schematic diagram of a printer that uses an inkjet printhead to form printed images.

For a general understanding of the environment for the device disclosed herein as well as the details for the device, reference is made to the drawings. In the drawings, like reference numerals designate like elements.

Figure 6:
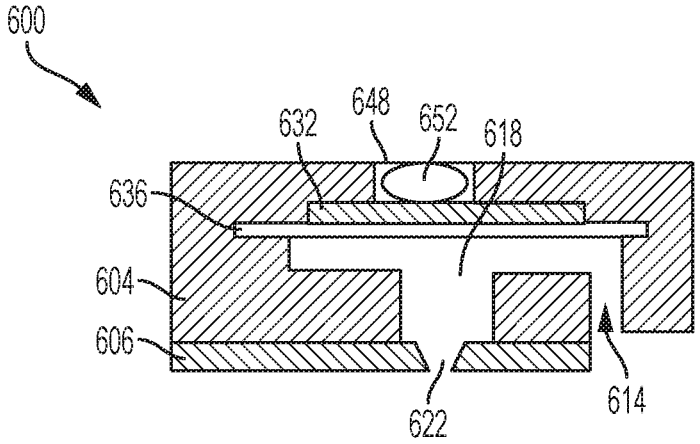
FIG. 6 PRIOR ART
FIG. 6 is a cross-sectional view of a prior art inkjet.

As used herein, the term "inkjet" refers to a structure in a printhead that ejects a drop of ink in response to an electrical signal. FIG. 6 depicts an illustrative embodiment of a prior art piezoelectric inkjet 600, although alternative inkjet embodiments are known to the art. The inkjet 600 includes a housing layer 604 that defines a fluid inlet channel 614 and a fluid pressure chamber 618 and a printhead face layer 606 that includes a nozzle orifice 622. The inkjet 600 further includes an electrical contact 648, a flexible conductor 652, such as an electrically conductive epoxy, a piezoelectric actuator 632, and a diaphragm 636, which is typically a thin stainless steel sheet, affixed to the piezoelectric actuator 632. An inkjet printhead includes at least one inkjet, and in some inkjet printhead embodiments include two dimensional arrays of hundreds or thousands of inkjets with the configuration of the inkjet 600 or similar configurations.

During operation of the inkjet 600, liquefied ink supplied by a reservoir (not shown) in a printhead that contains the inkjet 600 flows through the fluid inlet 614 into the pressure chamber 618. Surface tension holds the ink in place across the opening of the nozzle 622. A firing electrical signal applied to the piezoelectric actuator 632 via the electrical contact 648 and conductor 652 causes the piezoelectric actuator 632 to change shape and deflect the diaphragm 636 into the pressure chamber 618 towards the nozzle 622. The deflection of the diaphragm 636 urges ink from the pressure chamber 618 through the orifice of the nozzle 622 in the form of an ejected ink drop. While the inkjet 600 includes a piezoelectric actuator, other embodiments use a different electromechanical actuator device that operates in response to both non-firing and firing electrical signals.

As used herein, the terms "non-firing electrical signal" or "non-firing signal" are used interchangeably and refer to an electrical signal that an electrical signal generator in a printer applies to an actuator in an inkjet of a printhead that does not operate the inkjet to eject a drop of ink. Even though the inkjet does not eject a drop of ink in response to the non-firing electrical signal, the application of this signal produces a physical change within a pressure chamber of the inkjet. For example, in the inkjet 600 the non-firing electrical signal produces a deformation in the piezoelectric actuator 632 and the diaphragm 636 that can draw additional ink into the pressure chamber 618 via the fluid inlet 614 to prime the inkjet for operation. In particular, the application of the non-firing electrical signal agitates liquefied ink that is held within the pressure chamber of the inkjet that is known to the art to provide benefits to operation of the inkjet to eject ink drops within a comparatively short time (e.g. within 10-20 seconds) of applying the non-firing electrical signals to the transducer in the printhead.

As used herein, the terms "firing electrical signal" or "firing signal" are used interchangeably and refer to an electrical signal that the electrical signal generator in a printer applies to an actuator in an inkjet of a printhead that operates the inkjet to eject a drop of ink. In at least some printhead embodiments, the firing signals have a larger amplitude and duration than the non-firing signals to drive the actuator in the inkjet to expel an ink drop through a nozzle orifice towards an image receiving surface in the printer. As is known in the art, the generation of firing signals at controlled times operates one or more inkjets in a printhead to eject ink drops in a two-dimensional pattern that forms a printed image.

As used herein, the term "ink" refers to any liquefied material that is ejected from inkjets in a printhead. Examples of ink include, but are not limited to, aqueous and solvent based inks that are used to form monochrome and color images in a wide range of printing applications including printing on paper or other print media and in forming three-dimensional objects during additive manufacturing processes.

As used herein, the term "process direction" refers to a direction of relative motion between a printhead and a surface of an image receiving member that receives ink drops that inkjets in the printhead eject during operation of the printhead. For example, in some printer embodiments each inkjet in the printhead ejects drops at controlled times as the image receiving member moves past the printhead in the process direction. Each inkjet ejects ink drops that form one column of a printed image. In addition to having a spatial component, the process direction also refers to time since the printer controls the time of operation of the inkjets to form columns of the printed ink drops along the process direction in a printed image. As used herein, the term "cross-process direction" refers to an axis that is perpendicular to the process direction across the surface of the image receiving member. Multiple inkjets in the printhead form columns of printed ink drops in a printed image that are arranged along the cross-process direction to form a two-dimensional printed pattern based on a two-dimensional array of image data.

FIG. 1 depicts a simplified illustration of select components in a printer 100. The printer 100 includes an image receiving member 102, a printhead 104, a controller 128, and a memory 132. In the printer 100, the printhead 104 is configured to eject ink drops onto the surface of the image receiving member 102 to form printed images or patterns of material that form layers of an object in an additive manufacturing process. The image receiving member 102 is, for example, a media substrate such as paper, an indirect image receiving member such as an endless belt or drum, or a support member that provides a base to support a three-dimensional printed object during an additive manufacturing process. During a printing operation, the image receiving member 102 moves past the printhead 104 in the process direction P as the printhead 104 ejects drops of ink onto different locations on the surface of the image receiving member 102, although in alternative printer embodiments the printhead 104 moves along the process direction P.

The printhead 104 includes an electrical signal generator 108, an ink reservoir 112, and a plurality of inkjets 116. While FIG. 1 depicts a single printhead for illustrative purposes, alternative printer configurations include arrays of two or more printheads that eject ink drops to form printed images or produce three-dimensional objects during additive manufacturing processes.

The ink electrical signal generator 108 is, for example, a programmable electrical waveform generator that incorporates one or more oscillators, modulators, amplifiers, and other components that are known to the art to generate electrical signals with varying amplitude levels and waveform shapes, including both the non-firing electrical signals and the firing electrical signals. The electrical signal generator 108 is electrically connected to the actuators in each of the inkjets 116. The electrical signal generator 108 receives control signals from the controller 128 to determine when the electrical signal generator 108 produces an output electrical signal for each of the inkjets 116 and which type of waveform (e.g. non-firing signal or firing signal) the electrical signal generator 108 produces for the inkjet. While FIG. 1 depicts the electrical signal generator 108 located within the housing of the printhead 104, in some embodiments, the electrical signal generator 108 is located outside of the printhead and is connected to the inkjets via electrical cables.

The ink reservoir 112 is a cavity formed in the housing of the printhead 104 that holds liquefied ink. In some embodiments a heater in the printhead 104 elevates the temperature of the reservoir 112 to elevate the temperature of ink in the reservoir 112 to maintain the ink in the liquefied state. The ink reservoir 112 is fluidly coupled to each of the inkjets 116 to supply the ink to the inkjets. While the printhead 104 includes a single reservoir 112, some printheads that eject multiple colors or material types include multiple reservoirs that are each fluidly coupled to a different subset of the inkjets in the printhead.

In the printhead 104, the inkjets 116 are arranged in a two-dimensional array configuration with outlet nozzles arranged in a printhead face that is parallel to the image receiving surface 102 and extending along the process direction P and the cross-process direction CP. Each of the inkjets 116 is configured in a similar manner to the inkjet 600 of FIG. 6.

In the printer 100 of FIG. 1, the controller 128 is implemented using one or more very-large scale integrated circuit (VLSI) digital logic devices including, for example, one or more microprocessors, microcontrollers, field programmable gate arrays (FPGAs), digital signal processors (DSPs), application specific integrated circuits (ASICs) and the like. During operation, the controller 128 executes stored program data 136 that are stored in the memory 132 to control the operation of the printhead 104 to enable the signal generator 108 to generate both the non-firing electrical signals and firing electrical signals to control the operation of the inkjets 116 in the printhead 104.

The controller 128 is operatively connected to the printhead 104 and memory 132 to enable the printer 100 to perform the operations described herein. As described in more detail below, during operation the controller 128 identifies the number of ink drop ejections that each inkjet 116 in the printhead 104 performs to form a printed image at a time prior to actually forming the printed image based on image data stored in the memory 132. The controller 128 generates control data sequences for each inkjet to control the number of times that the signal generator 108 in the printhead 104 applies a non-firing electrical signal to the actuator in each of the inkjets 116. As set forth in more detail below, the inkjets that are activated a larger number times to form the printed image receive a larger number of the non-firing electrical signals while the inkjets that eject a smaller number of ink drops receive fewer of the non-firing electrical signals to improve the operation of each of the inkjets 116 in the printhead 104.

The memory 132 includes, for example, non-transitory digital data storage devices that include both volatile memory devices, such as random access memory (RAM), that retain information when supplied with electrical power and non-volatile memory devices, such as magnetic, optical, and solid-state data storage devices, that retain data in the presence or absence of electrical power. In the configuration of FIG. 1, the memory 132 stores the stored program instruction data 136, stored two-dimensional image data for one or more printed images 140, a lookup table (LUT) 148 that stores a predetermined relationship between numeric counts of the number of ink drop ejections that each inkjet performs to form a portion of the image mapped to a number of times that the actuator in the inkjet receives a non-firing electrical signal prior to ejecting the ink drops, and a set of one or more predetermined non-firing signal control sequences 144 that the controller 128 uses to operate the electrical signal generator 108 in the printhead 104 to apply non-firing electrical signals to the actuators in the inkjets 116.

In the memory 132, the stored image data 140 optionally include both contone and halftoned sets of image data for one or more pages in a printed document or patterns for different layers of objects produced during additive manufacturing. In the processes that are described below, the controller 128 analyzes binary halftoned image data that form a two dimensional pattern that directly maps to the control of the individual inkjets in the printhead 104. For example, a two-dimensional arrangement of the halftoned binary image data includes a plurality of pixel columns where each pixel column corresponds to a set of image data for a single one of the inkjets 116 in the printhead 104 arranged along the process direction P. Each pixel in the column includes a binary value (e.g. a "1" or "0") that specifies whether or not inkjet ejects an ink drop at the particular pixel location to form a portion of the printed image.

Figure 4:
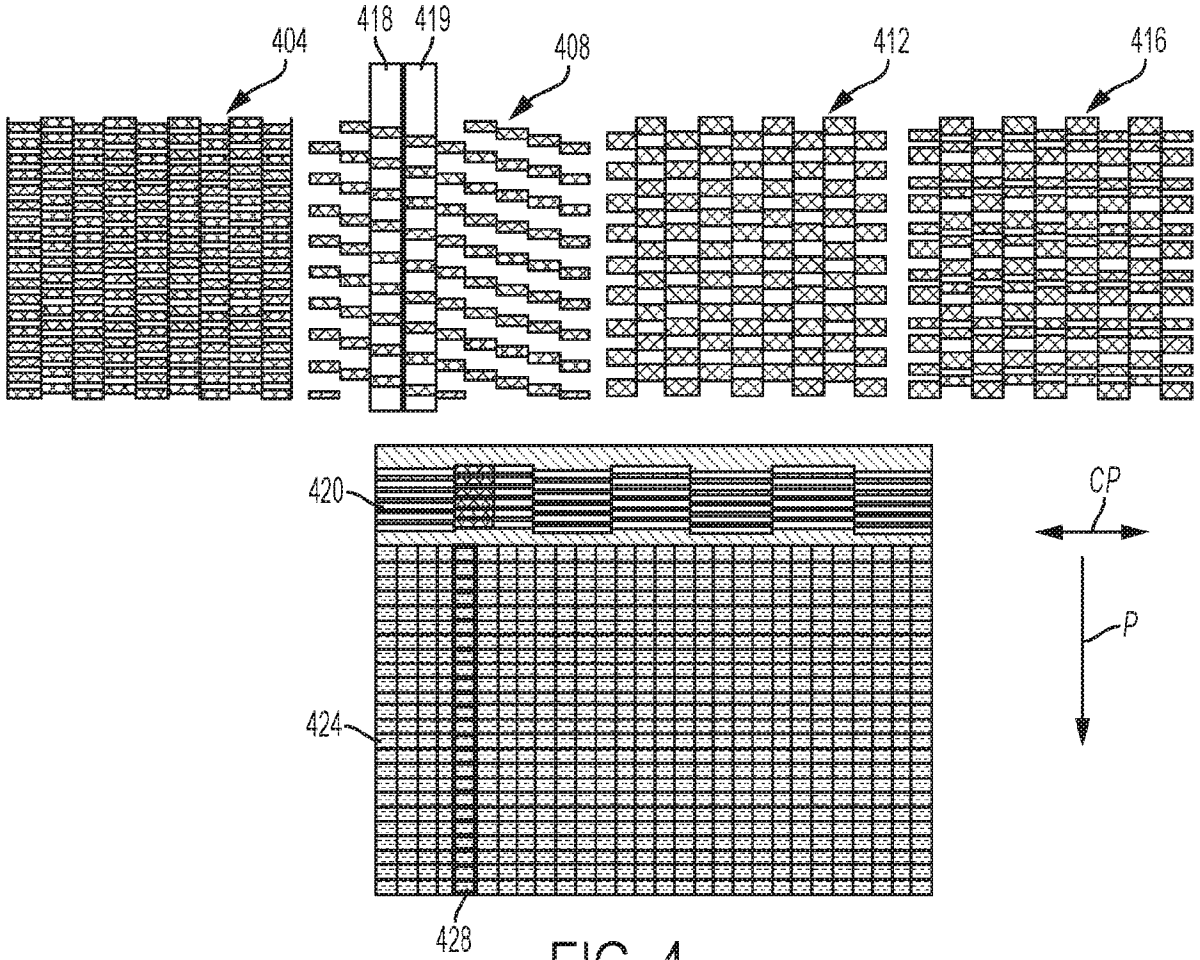
FIG. 4 is a diagram depicting image data for a printed image and predetermined control sequences for non-firing electrical signals to be applied to different inkjets in a printhead.

FIG. 4 depicts binary image data as an array of pixels 424 that the controller 128 uses to control the operation of inkjets 116 in the printhead 104. In the pixel array 424, the column of pixels 428 corresponds to the image data for a single inkjet over time as the print medium moves in the process direction P past the printhead 104. Each column in the pixel array 424 corresponds to one of the inkjets 116 in the printhead 104 and the columns are arranged along the cross-process direction axis CP in a manner that corresponds to the physical arrangement of inkjets 116 in the printhead 104. As is described in more detail below, the controller 128 generates a sum of the number of pixels in each column that contain a value indicating that the inkjet should eject an ink drop to generate numeric counts of the number of ink drop ejections that each inkjet 116 in the printhead 104 performs to form a printed image corresponding to the image data.

Referring again to FIG. 1, the memory 132 stores the non-firing electrical signal control sequences 144 as a set of binary image data that specify a predetermined sequence of non-firing electrical signals that are to be applied to one or more inkjets 116 in the printhead 104. FIG. 4 depicts an example of several predetermined control sequences 404, 408, 412, and 416. In the predetermined control sequences, the dark sections correspond to control signals that activate the electrical signal generator 108 to apply the non-firing electrical signal to the actuator in a printhead, and the white sections correspond to time intervals between the generation of the individual non-firing electrical signals. Each column corresponds to a single inkjet in the printhead 104. As depicted in FIG. 4, different columns of the predetermined control sequences are offset from each other in time along the process direction P to ensure that different groups of inkjets in the printhead 104 do not receive the non-firing electrical control signals simultaneously.

As depicted in FIG. 4, the predetermined control sequence for the column 418 corresponding to a first inkjet specifies the start of the non-firing electrical signals at an earlier time than the adjacent column 419 for another inkjet in the printhead 104. The two sequences in columns 418 and 419 are offset from each other to ensure that the actuators in the two inkjets do not receive the non-firing electrical signals simultaneously, with the inkjet corresponding to column 418 receiving the non-firing electrical signals during time intervals in the control data for the inkjet corresponding to column 419 and vice-versa. In at least some printhead configurations, the printer 100 applies the non-firing electrical signals to different subsets of the inkjets 116 at different times to improve the effects of the non-firing electrical signals for different inkjets. Staggering of the firing signals can be useful for various printhead embodiments based on the microfluidic and electrical characteristics of the printhead. The staggering reduces or eliminates resonances that may occur within the printhead—these may be fluidic, mechanical, or electronic resonances. The staggering also reduces the instantaneous electrical power that is required from the electronics that drive the electrical signals, which potentially reducing failures related to excess power output. For some heads, pre-fire pulses are more likely to induce real drops albeit small ones as more ejectors are fired simultaneously.

As described in more detail below, the printer 100 generates control data for multiple inkjets that masks at least one of the activations in the predetermined control sequences 404-416 to ensure that each inkjet receives at least one fewer non-firing electrical signal than is specified in the predetermined control sequences. As used herein, the term "mask" refers to an operation of a digital processing device, such as the controller 128, to modify a portion of the digital data in the predetermined control sequence to remove digital values that specify the operation of the electrical signal generator 108 in the printhead 104 to generate a non-firing electrical signal. For example, in one embodiment a binary predetermined control sequence includes a series of "0" and "1" values where each "1" value indicates a period of time during which the electrical signal generator 108 generates the non-firing electrical signal. The controller 128 applies an exclusive-or (XOR) or other suitable binary data operation to "mask" or set the "1" values to "0" in a portion of the predetermined control sequence to control the number of times that the electrical signal generator 108 actually generates the non-firing electrical signal for different inkjets 116 in the printhead 104.

As depicted in FIG. 4, in some embodiments the memory 132 stores a plurality of the predetermined non-firing electrical signal control sequences 144, such as the sequences 404-416. In some embodiments, the controller 128 selects one of the control sequences from the memory 132 for each page, and the controller 128 cycles through the predetermined control sequences for each printed image in a print job to select a first predetermined control sequence from a plurality of predetermined control sequences 144 stored in the memory 132 where the first predetermined control sequence is selected in a predetermined order and the first predetermined control sequence is different than a second predetermined control sequence that was previously selected to control generation of non-firing electrical signals for another printed image, such as a previous page in a print job. For example, in the illustrative embodiment of FIG. 4, the controller 128 cycles through the predetermined control sequences 404-416 to select one of the control sequences for each printed image in a sequence of printed images in a print job. The controller 128 generates control data based on a different predetermined control sequence for each printed image compared to the previous printed image in the print job.

In the embodiment of FIG. 4 the image data 420 depicts a set of the control data that are generated based on the predetermined control sequences in a configuration where the image data 420 are prepended to the image data 424 for a printed image. In the print zone of the printer 100, the prepended image data 420 correspond spatially to an inter-document zone over the receiving surface 102 in which the printhead 104 does not normally eject ink drops, while the image data 424 correspond to a region over a print medium or other image receiving surface that receives printed ink drops to form a printed image. The image data 420 encode sequences of non-firing electrical signals that enable the controller 128 to control the operation of the electrical signal generator 108 in the printhead 104 to generate the non-firing electrical signals for the inkjets 116 in a similar manner to control the signal generator 108 to operate the inkjets 116 to eject the ink drops based on the image data 424 for the printed image.

Figure 5:
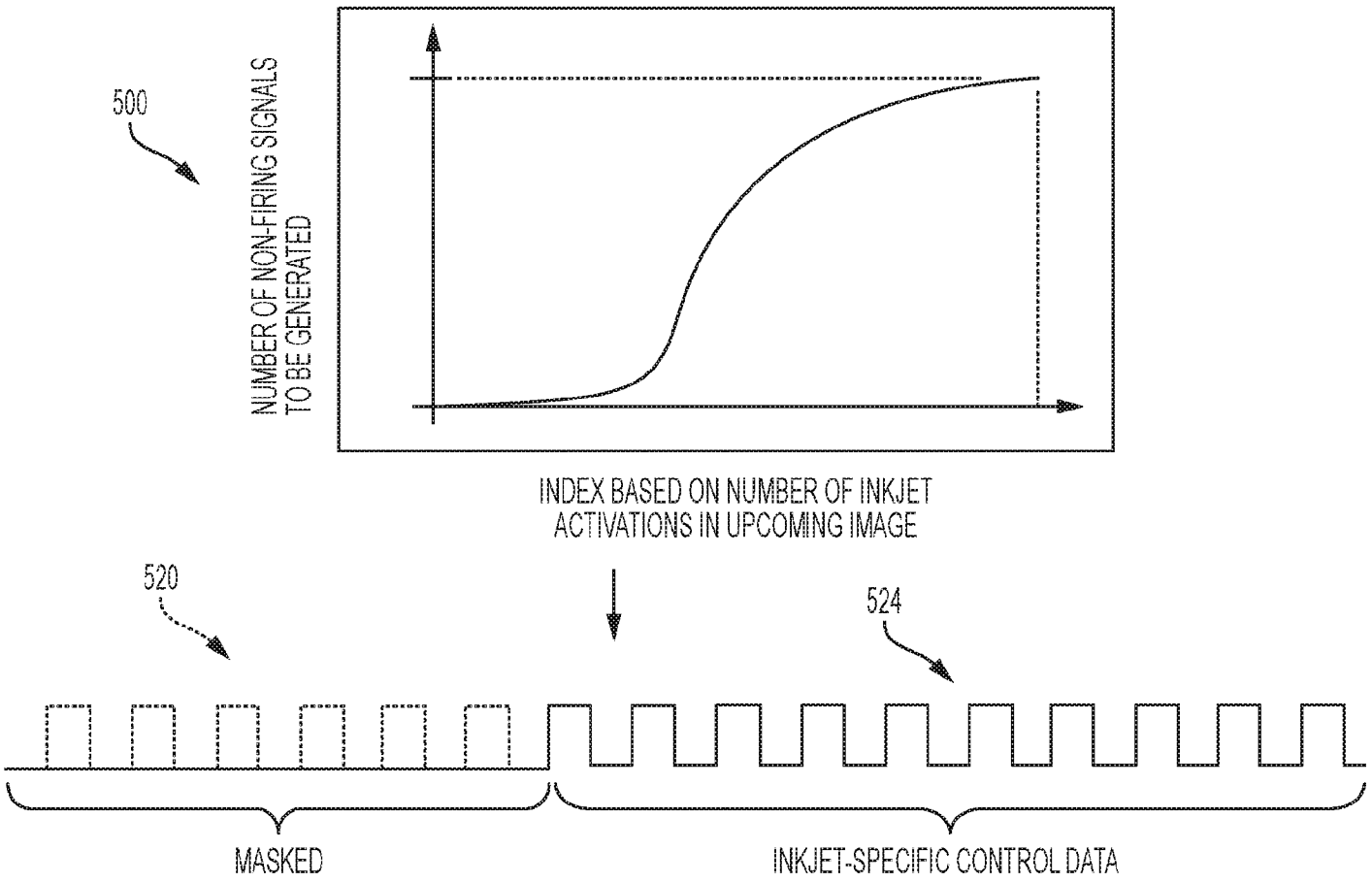
FIG. 5 is a diagram depicting a lookup table that is used to determine a number of non-firing electrical signals to be applied to inkjets in a printhead and control data that specify the non-firing electrical signals that are applied to an inkjet in the printhead.

Referring again to FIG. 1, the LUT 148 in the memory 132 includes a predetermined mapping between the number of times that each inkjet is operated to eject ink drops to form the printed image and a corresponding value for the number of non-firing signals that the controller 128 and signal generator 108 apply to the actuator in the inkjet prior to the printing operation. FIG. 5 depicts a graphical illustration of the LUT 148 as a graph 500, although those of skill in the art will recognize that the memory 132 stores the LUT 148 using, for example, a numerical array or key-value store that maps the number of activations for each inkjet to the number of times that the inkjet should receive a non-firing signal prior to forming the printed image. In the printer 100, the precise values of the graph 500 are determined using an empirical process to assess the quality of inkjet operation based on the number of ink drop ejections that each inkjet performs to form a printed image and the number of non-firing electrical signals that the electrical signal generator 108 applies to each inkjet prior to forming the printed image. The precise shape of the curve in the graph 500 may be different than the example depicted in FIG. 5 for different printhead configurations.

In FIG. 5, the graph 500 depicts the number of non-firing electrical signals that are applied to an inkjet increasing monotonically to a predetermined maximum number as the identified number of activations for the inkjet to form a printed image increases. The number of non-firing electrical signals increases from a predetermined minimum value (e.g. zero if the inkjet remains inactive or is only activated a small number of times) up to the predetermined maximum value if the inkjet is activated numerous times to form a printed image. Thus, as described above, the controller 128 generates varying numbers of non-firing electrical signals for different inkjets in the printhead based on how often each inkjet is activated to form a particular image, and the specific patterns of the non-firing electrical signals that are applied to the actuator in each inkjet vary as the printer 100 processes different sets of image data for different printed images.

More particularly, the printer 100 controls the generation of the non-firing signals based on a positive relationship between the number of non-firing signals that are generated for each inkjet and the number of times that the inkjet will be operated to eject ink drops during an upcoming printing operation. That is to say, the number of non-firing electrical signals that the printer 100 generates for a given inkjet increases for inkjets that eject a greater number of ink drops to form a printed image and decreases for inkjets that eject fewer ink drops or no ink drops to form the printed image. The graph 500 depicts one embodiment of the positive relationship. In some instances an inkjet may operate several hundred or thousand times to produce a printed image. In the graph 500, the more heavily used inkjets reach the predetermined maximum number (or ceiling value) corresponding to the maximum number of non-firing electrical signals that are generated for any inkjet in the printhead, and the number of non-firing electric signals ceases to increase beyond the predetermined maximum number.

As depicted in FIG. 5, the controller 128 generates control data for one of the inkjets 116 based on the numeric value retrieved from the lookup table 500. To generate the control data for one of the inkjets 116, the controller 128 masks a portion of the predetermined control sequence 520 while retaining a portion of the predetermined control sequence 524 that specifies the number of times to apply the non-firing electrical signal to the actuator in the inkjet. The controller 128 masks one or more of the entries in the predetermined control sequence to generate the control data that include at least one fewer generation of the non-firing electrical signals than is specified in the first predetermined control sequence. The controller 128 identifies the number of masked entries in the predetermined control sequence based upon the number of times that an inkjet is activated to eject ink drops to form the printed image, which the controller 128 identifies from the image data 140. For example, a first inkjet and a second inkjet that are activated different numbers of times produce different numeric indices to the lookup table 500. The controller 128 generates first and second control data for the first and second inkjets, respectively, that specify different counts for the application of the non-firing electrical signals to the actuator in each inkjet.

The illustration of FIG. 1 depicts a simplified illustration of selected components within a printer 100 for explanatory purposes. Various configurations of the printer 100 include, for example, direct printers that eject ink drops directly onto paper or other print media, indirect printers that eject drops onto an intermediate belt or drum for later transfer to a print medium, and three-dimensional object printers that eject drops of materials that form three-dimensional printed objects in an additive manufacturing process.

Figure 2:
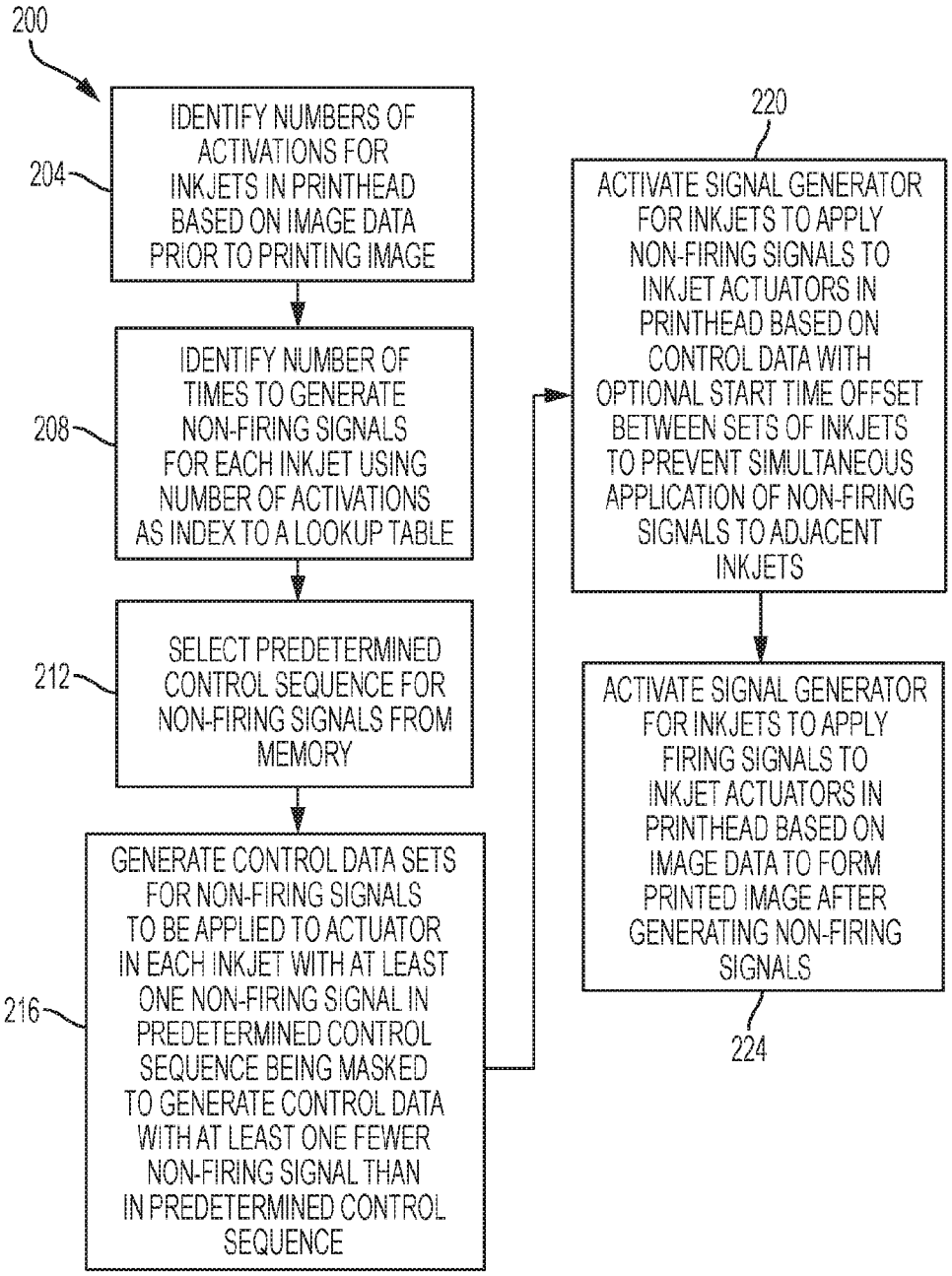
FIG. 2 is a block diagram of a process for operation of a printhead in an inkjet printer to apply non-firing signals to inkjets in an inkjet printhead prior to forming a printed image using the printhead.

FIG. 2 depicts a block diagram of a process 200 for operation of a printhead in an inkjet printer to apply non-firing signals to inkjets in an inkjet printhead prior to forming a printed image using the printhead. In the discussion below, a reference to the process 200 performing a function or action refers to the operation of a controller to execute stored program instructions to perform the function or action in association with other components in an inkjet printer. The process 200 is described in conjunction with the printer 100 of FIG. 1 for illustrative purposes.

The process 200 begins as the controller 128 identifies a number of ink drop ejections for each inkjet in the plurality of inkjets 116 in the printhead 104 prior to operation of the printhead to form the printed image (block 204). In the printhead 104, each of the inkjets 116 forms a portion of the printed image, and the controller 128 identifies the number of ink drop ejections for each inkjet with reference to a column of the image data that corresponds to each inkjet, such as column 428 in the image data 424 of FIG. 4. The column 428 corresponds to a first inkjet, and the controller 128 generates a sum of the number of pixels in the column 428 that specify operation of the inkjet. The controller 128 performs the same process for the image data corresponding to each of the inkjets 116 in the printhead 104.

The process 200 continues as the controller 128 identifies a number of non-firing electrical signals to be applied to each inkjet in the printhead 104 using the lookup table 148 stored in the memory 132 (block 208). In the printer 100, the controller 128 identifies the number of non-firing electrical signals in the lookup table 148 stored in the memory 132 using the identified number of ink drop ejections for each inkjet as an index to the lookup table as described above in relation to FIG. 5.

During the process 200, the controller 128 selects a predetermined control sequence for the generation of the non-firing electrical signals for the inkjets 116 in the printhead 104 from the plurality of predetermined non-firing electrical signal control sequences 144 that are stored in the memory 132 (block 212). In the system 100, the controller 128 selects one of the predetermined control sequences, such as one of the sequences 404-416 that are depicted in FIG. 4, from the memory 132 in a in a predetermined order, with one of the predetermined control sequences being selected for each printed image that the printer 100 produces. During each execution of the process 200, the controller 128 selects a predetermined control sequence that is different than another predetermined control sequence that was previously selected to control generation of non-firing electrical signals for the previous printed image. Those of skill in the art will recognize that the processing that is described above with reference to the processing of blocks 204-212 corresponding to each inkjet in the plurality of inkjets 116 can occur in any order or concurrently.

The process 200 continues as the controller 128 generates control data for each of the inkjets 116 in the printhead 104 to control the operation of the electrical signal generator 108 to apply the non-firing electrical signals to the actuator of each of the inkjets 116 prior to forming the printed image (block 216). As described above, the controller 128 generates control data that specify a sequence of non-firing electrical signals to be applied to an actuator in each inkjet with reference to the selected predetermined control sequence and the number of ink drop ejections that the controller 128 identifies for each inkjet based on the image data. Each set of control data includes at least one fewer generation of the non-firing electrical signals than is specified in the selected predetermined control sequence. For example, as depicted in FIG. 5 the controller 128 masks a portion of the control sequence 520 that exceed the number of non-firing electrical signals identified in the lookup table to generate the first control data to reduce the number of times that the signal generator 108 in the printhead 104 applies the non-firing electrical signal to one of the inkjets 116. Since different inkjets in the printhead 104 perform different numbers of ink drop ejection operations to form the printed image, the controller 128 identifies different numbers of the non-firing signals to be applied to the different inkjets and generates multiple sets of control data that include different number of generations of the non-firing electrical signals for different inkjets 116 in the printhead 104.

The process 200 continues as the controller 128 uses the control data that are generated for each of the inkjets to control the electrical signal generator 108 to apply the non-firing electrical signals to the actuators in the inkjets 116 prior to operating the printhead 104 to form a printed image (block 220). The controller 128 operates the electrical signal generator 108 to generate the non-firing electrical signals for each inkjet based on the generated control data, including at least one fewer generation of the non-firing electrical signals than is specified in the selected predetermined control sequence. As described above, the controller 128 and electrical signal generator 108 generate different numbers of the non-firing electrical signals for at least two inkjets in the printhead 104 using different sets of control data that are generated for two different inkjets that perform different numbers of ink drop ejections to form the printed image.

As described above, the controller 128 optionally controls the electrical signal generator 108 to produce a start time offset between different sets of inkjets in the printhead 104 to prevent simultaneous application of non-firing signals to adjacent inkjets in the printhead 104, such as the offset in the control data in columns 418 and 419 for two different inkjets 116 in the printhead 104. The controller 128 starts the generation of the non-firing electrical signals for the first inkjet at a first time that is different than a second start time for a second inkjet in the printhead 104 to enable generation of each non-firing electrical signal in a plurality of non-firing electrical signals for the first inkjet only during time intervals that occur between the generation of the second plurality of non-firing electrical signals for the second inkjet.

The process 200 continues as the controller 128 operates the electrical signal generator 108 in the printhead 104 to operate the inkjets 116 in the printhead 104 to eject ink drops based on the image data to form the printed image (block 224). As described above, the electrical signal generator 108 eject generates the firing signals for the actuators in the inkjets 116 to control the ejection of the ink drops that form the printed image on the surface of the image receiving member 102. The controller 128 operates the electrical signal generator 108 to produce a plurality of firing electrical signals for the inkjets 116 in the printhead 104 after generating every non-firing electrical signal for the inkjets 116 prior to printing the image. In some configurations, the printer 100 repeats the process 200 to print multiple images in a print job with the application of the non-firing electrical signals to the individual inkjets 116 in the printhead 104 prior to forming each printed image, or intermittently (e.g. prior to forming every second image, third image, etc. in a print job).

Figure 3:
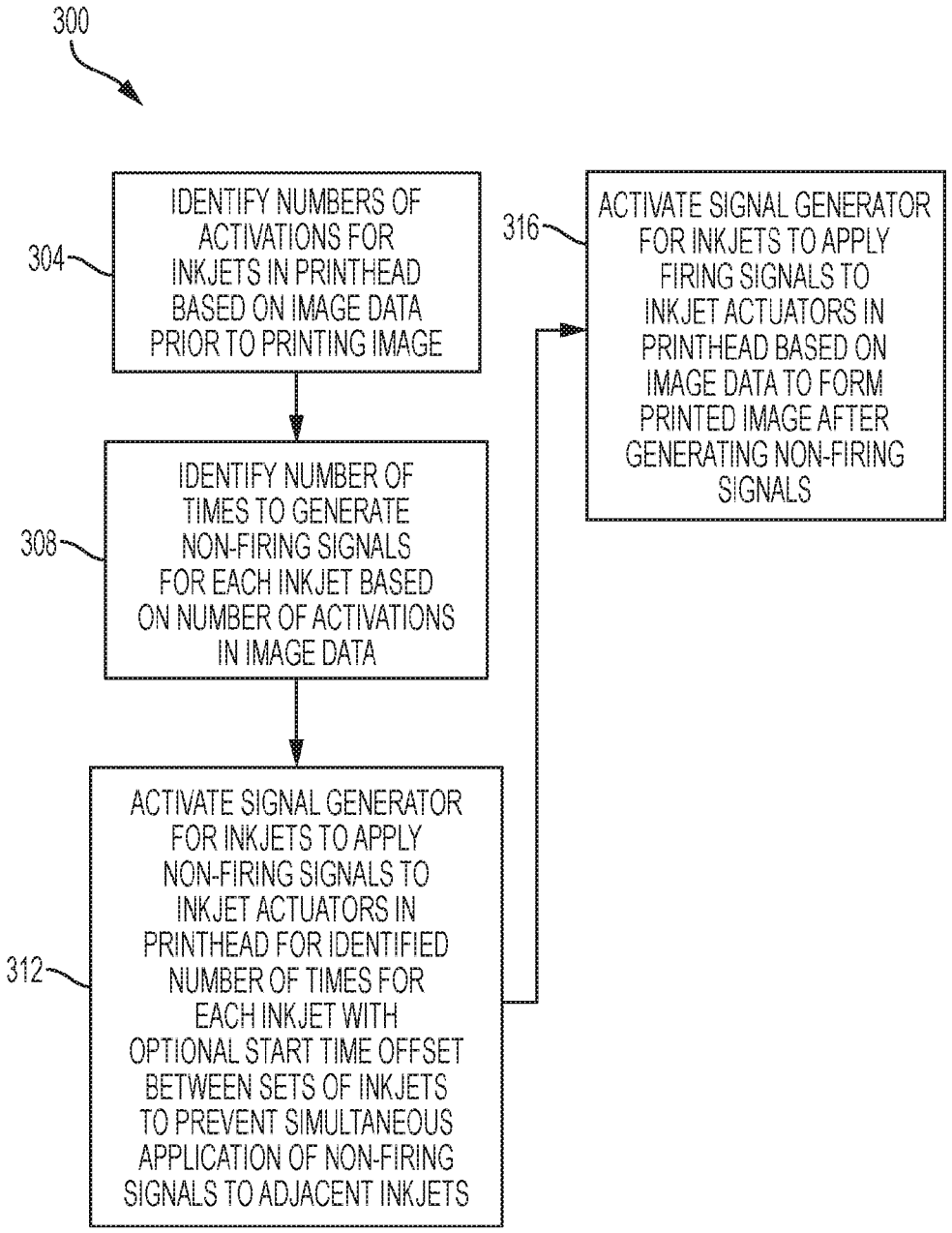
FIG. 3 is a block diagram of another process for operation of a printhead in an inkjet printer to apply non-firing signals to inkjets in an inkjet printhead prior to forming a printed image using the printhead.

FIG. 3 depicts a block diagram of a process 300 for operation of a printhead in an inkjet printer to apply non-firing signals to inkjets in an inkjet printhead prior to forming a printed image using the printhead. In the discussion below, a reference to the process 300 performing a function or action refers to the operation of a controller to execute stored program instructions to perform the function or action in association with other components in an inkjet printer. The process 300 is described in conjunction with the printer 100 of FIG. 1 for illustrative purposes.

The process 300 begins as the controller 128 identifies a number of ink drop ejections for each inkjet in the plurality of inkjets 116 in the printhead 104 prior to operation of the printhead to form the printed image (block 304). In the printhead 104, each of the inkjets 116 forms a portion of the printed image, and the controller 128 identifies the number of ink drop ejections for each inkjet with reference to a column of the image data that corresponds to each inkjet, such as column 428 in the image data 424 of FIG. 4. The column 428 corresponds to a first inkjet, and the controller 128 generates a sum of the number of pixels in the column 428 that specify operation of the inkjet. The controller 128 performs the same process for each of the inkjets 116 in the printhead 104.

The process 300 continues as the controller 128 identifies a number of non-firing electrical signals to be applied to each inkjet in the printhead 104, using in one embodiment, the lookup table 148 stored in the memory 132 (block 308). In the printer 100, the controller 128 identifies the number of non-firing electrical signals in the lookup table 148 stored in the memory 132 using the identified number of ink drop ejections for each inkjet as an index to the lookup table as described above in relation to FIG. 5. In another configuration, the controller 128 identifies the number of non-firing electrical signals to be applied to the actuator in each inkjet based on a predetermined function ranging from a minimum value (e.g. zero non-firing electrical signals) up to a predetermined maximum number of the non-firing electrical signals without requiring the use of a predetermined lookup table. The controller 128 identifies the number of non-firing electrical signals to be generated for each inkjet based on the positive relationship that is described above between the identified number of ink drop ejections for the inkjet during an upcoming printing operation and the number of non-firing electrical signals that the electrical signal generator 108 produces for the inkjet. In some embodiments, the controller 128 adjusts the positive relationship between the number of ink drop ejections that each inkjet performs when printing an image and the number of non-firing electrical signals that are applied to the inkjet based on the overall size of the upcoming printed image, which is often related to the page size of printed media, and the process speed at which the printer 100 produces the upcoming image, such as a number of images or pages printed per minute.

For example, in one embodiment the controller 128 identifies the number of non-electrical firing signals to be generated for an inkjet based on the number of ink drop ejections using a lower threshold that corresponds to a minimum number of non-firing electrical signals (e.g. zero non-firing electrical signals) and an upper threshold that corresponds to a maximum number of non-firing electrical signals (e.g. up to 128 total non-firing electrical signals in one embodiment). If the number of ink drop ejections is between the lower threshold and the upper threshold, then the controller 128 identifies an intermediate number of non-firing electrical signals between the predetermined minimum and maximum numbers proportionate to the number of ink drop ejections.

The process 300 continues as the controller 128 and the electrical signal generator 108 generate the non-firing electrical signals for the actuator in each of the inkjets 116 with each inkjet receiving the number of non-firing electrical signals that is identified above as described with reference to the processing of block 308 (block 312). For example, in the printer 100 the controller 128 and the electrical signal generator 108 apply a plurality of non-firing electrical signals including a first number of non-firing electrical signals corresponding to a first number of ink drop ejections to the actuator in a first one of the inkjets 116 of the printhead 104. Similarly, the controller 128 and the electrical signal generator 108 generate different numbers of the non-firing electrical signals for different inkjets 116 in the printhead 104 based on the number of ink drop ejections that each inkjet performs to produce the printed image data as identified in the image data. The controller 128 and signal generator 108 generate a second plurality of non-firing electrical signals applied to an actuator in a second one of the inkjets 116, where the second plurality of non-firing electrical signals includes a second number of non-firing electrical signals corresponding to the second number of ink drop ejections that is different from the first number of non-firing signals that are applied to the actuator in the first inkjet.

During the process 300, the controller 128 and the signal generator 108 generate the non-firing electrical signals for the different inkjets 116 in the printhead 104 prior to operating the printhead 104 to form the printed image. In the process 300, the controller 128 does not use a predetermined control sequence to generate the control data for each inkjet in the manner that is described above in the process 200. Instead, the controller 128 operates the signal generator 108 to generate the identified number of non-firing electrical signals at a predetermined frequency up to the predetermined maximum number of non-firing signals for any of the inkjets 116 in the printhead 104.

As described above, the controller 128 optionally controls the electrical signal generator 108 to produce a start time offset between different sets of inkjets in the printhead 104 to prevent simultaneous application of non-firing signals to adjacent inkjets in the printhead 104. During the process 300, the controller 128 starts the generation of the non-firing electrical signals for a first inkjet at a first time that is different than a second start time for a second inkjet in the printhead 104 to enable generation of each non-firing electrical signal in a plurality of non-firing electrical signals for the first inkjet only during time intervals that occur between the generation of the second plurality of non-firing electrical signals for the second inkjet.

The process 300 continues as the controller 128 operates the electrical signal generator 108 in the printhead 104 to operate the inkjets 116 in the printhead 104 to eject ink drops based on the image data to form the printed image (block 316). As described above, the electrical signal generator 108 generates the firing signals for the actuators in the inkjets 116 to control the ejection of the ink drops that form the printed image on the surface of the image receiving member 102. The controller 128 operates the electrical signal generator 108 to produce a plurality of firing signals for the inkjets 116 in the printhead 104 after generating every non-firing electrical signal for the inkjets 116 prior to printing the image. In some configurations, the printer 100 repeats the process 300 to print multiple images in a print job with the application of the non-firing electrical signals to the individual inkjets 116 in the printhead 104 prior to forming each printed image, or intermittently (e.g. prior to forming every second image, third image, etc. in a print job).

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method for operating a printhead in a printer comprising:

identifying, with a controller, a first number of ink drop ejections for a first inkjet in a plurality of inkjets in the printhead to form a first portion of a printed image with reference to image data corresponding to the printed image prior to operation of the printhead to form the printed image;

generating, with the controller, first control data that specify a sequence of a plurality of non-firing electrical signals to be applied to an actuator in the first inkjet with reference to a first predetermined control sequence stored in a memory of the printer and the first number of ink drop ejections, the first control data including at least one fewer generation of the plurality of non-firing electrical signals than specified in the first predetermined control sequence;

generating, with the controller and an electrical signal generator, a first plurality of non-firing electrical signals applied to the actuator in the first inkjet with reference to the first control data; and generating, with the controller and the electrical signal generator, a first plurality of firing electrical signals applied to the actuator in the first inkjet to eject ink drops from the printhead with reference to the image data, the first plurality of firing electrical signals being generated after the generating of every non-firing electrical signal in the first plurality of non-firing electrical signals.

2. The method of claim 1 further comprising:

identifying, with a controller, a second number of ink drop ejections for a second inkjet in the plurality of inkjets in the printhead to form another portion of the printed image with reference to the image data corresponding to the printed image prior to operation of the printhead to form the printed image, the second number of ink drop ejections being different than the first number of ink drop ejections;

generating, with the controller, second control data that specify another sequence of a plurality of non-firing electrical signals to be applied to an actuator in the second inkjet with reference to the first predetermined control sequence stored in the memory of the printer and the second number of ink drop ejections, the second control data including at least one fewer generation of the plurality of non-firing electrical signals than specified in the first predetermined control sequence and a different number of generations of the plurality of non-firing electrical signals than specified in the first control data;

generating, with the controller and the electrical signal generator, a second plurality of non-firing electrical signals applied to the actuator in the second inkjet with reference to the second control data; and generating, with the controller and the electrical signal generator, a second plurality of firing electrical signals applied to the actuator in the second inkjet to eject ink drops from the printhead with reference to the image data, the second plurality of firing electrical signals being generated after the generating of every non-firing electrical signal in the second plurality of non-firing electrical signals.

3. The method of claim 2, the generating of the first plurality of non-firing electrical signals and the second plurality of non-firing electrical signals further comprising:

generating, with the controller and the electrical signal generator, the first plurality of non-firing electrical signals starting from a first time; and generating, with the controller and the electrical signal generator, the second plurality of non-firing electrical signals starting from a second time, the second time being different from the first time, to enable generation of each non-firing electrical signal in the first plurality of non-firing electrical signals only during time intervals that occur between the generation of the second plurality of non-firing electrical signals.

4. The method of claim 1, the generating of the first control data further comprising:

selecting, with the controller, the first predetermined control sequence from a plurality of predetermined control sequences stored in the memory of the printer in a predetermined order, the first predetermined control sequence being different than a second predetermined control sequence that was previously selected to control generation of non-firing electrical signals for another printed image.

5. The method of claim 1, the generating of the first control data further comprising:

identifying, with the controller, a number of the first plurality of non-firing electrical signals to be applied to the first inkjet in a lookup table stored in the memory using the first number of ink drop ejections as an index to the lookup table; and masking, with the controller, a portion of the first predetermined control sequence that corresponds to generation of non-firing electrical signals that exceed the number of non-firing electrical signals identified in the lookup table to generate the first control data.

6. A method for operating a printhead in a printer comprising:

identifying, with a controller, a first number of ink drop ejections for a first inkjet in a plurality of inkjets in the printhead to form a portion of a printed image with reference to image data corresponding to the printed image prior to operation of the printhead to form the printed image;

generating, with the controller and an electrical signal generator, a first plurality of non-firing electrical signals applied to an actuator in the first inkjet, the first plurality of non-firing electrical signals including a first number of non-firing electrical signals corresponding to the first number of ink drop ejections; and generating, with the controller and the electrical signal generator, a first plurality of firing electrical signals applied to the actuator in the first inkjet to eject ink drops from the printhead with reference to the image data, the first plurality of firing electrical signals being generated after generating every non-firing electrical signal in the first plurality of non-firing electrical signals.

7. The method of claim 6 further comprising:

identifying, with the controller, the first number of non-firing electrical signals in a lookup table stored in a memory using the first number of ink drop ejections as an index to the lookup table.

8. The method of claim 6 further comprising:

identifying, with the controller, a second number of ink drop ejections for a second inkjet in the plurality of inkjets in the printhead to form another portion of the printed image with reference to the image data corresponding to the printed image prior to operation of the printhead to form the printed image, the second number of ink drop ejections being different than the first number of ink drop ejections;

generating, with the controller and an electrical signal generator, a second plurality of non-firing electrical signals applied to an actuator in the second inkjet, the second plurality of non-firing electrical signals including a second number of non-firing electrical signals corresponding to the second number of ink drop ejections, the second number being different than the first number; and generating, with the controller and the electrical signal generator, a second plurality of firing electrical signals applied to the actuator in the second inkjet to eject ink drops from the printhead with reference to the image data, the second plurality of firing electrical signals being generated after generating every non-firing electrical signal in the second plurality of non-firing electrical signals.

9. The method of claim 8 further comprising:

generating, with the controller and the electrical signal generator, the first plurality of non-firing electrical signals starting from a first time; and generating, with the controller and the electrical signal generator, the second plurality of non-firing electrical signals starting from a second time, the second time being different from the first time, to enable generation of each non-firing electrical signal in the first plurality of non-firing electrical signals only during time intervals that occur between the generation of the second plurality of non-firing electrical signals.

10. An inkjet printer comprising:

a printhead including a plurality of inkjets;

an electrical signal generator operatively connected to the plurality of inkjets in the printhead;

an image receiving member;

a memory; and a controller operatively connected to the electrical signal generator and the memory, the controller being configured to:

identify a first number of ink drop ejections for a first inkjet in the plurality of inkjets in the printhead to form a first portion of a printed image prior to operation of the printhead to form the printed image with reference to image data corresponding to the printed image stored in the memory;

generate first control data that specify a sequence of a plurality of non-firing electrical signals to be applied to an actuator in the first inkjet with reference to a first predetermined control sequence stored in the memory and the first number of ink drop ejections, the first control data including at least one fewer generation of the plurality of non-firing electrical signals than specified in the first predetermined control sequence;

generate a first plurality of non-firing electrical signals with the electrical signal generator with reference to the first control data, the first plurality of non-firing electrical signals being applied to the actuator in the first inkjet; and generate a first plurality of firing electrical signals with the electrical signal generator with reference to the image data, the first plurality of firing electrical signals being applied to the actuator in the first inkjet to eject ink drops from the printhead onto a surface of the image receiving member with reference to the image data, the first plurality of firing electrical signals being generated after the generation of every non-firing electrical signal in the first plurality of non-firing electrical signals.

11. The inkjet printer of claim 10, the controller being further configured to:

identify a second number of ink drop ejections for a second inkjet in the plurality of inkjets in the printhead to form another portion of the printed image with reference to the image data corresponding to the printed image prior to operation of the printhead to form the printed image, the second number of ink drop ejections being different than the first number of ink drop ejections;

generate second control data that specify another sequence of a plurality of non-firing electrical signals to be applied to an actuator in the second inkjet with reference to the first predetermined control sequence stored in the memory and the second number of ink drop ejections, the second control data including at least one fewer generation of the plurality of non-firing electrical signals than specified in the first predetermined control sequence and a different number of generations of the plurality of non-firing electrical signals than specified in the first control data;

generate a second plurality of non-firing electrical signals with the electrical signal generator with reference to the second control data, the second plurality of non-firing electrical signals being applied to the actuator in the second inkjet; and generate a second plurality of firing electrical signals with the electrical signal generator with reference to the image data, the second plurality of firing electrical signals being applied to the actuator in the second inkjet to eject ink drops from the printhead, the second plurality of firing electrical signals being generated after the generating of every non-firing electrical signal in the second plurality of non-firing electrical signals.

12. The inkjet printer of claim 11, the controller being further configured to:

generate the first plurality of non-firing electrical signals with the electrical signal generator starting from a first time; and generate the second plurality of non-firing electrical signals with the electrical signal generator starting from a second time, the second time being different from the first time, to enable generation of each non-firing electrical signal in the first plurality of non-firing electrical signals only during time intervals that occur between the generation of the second plurality of non-firing electrical signals.

13. The inkjet printer of claim 12, the controller being further configured to:

select the first predetermined control sequence from a plurality of predetermined control sequences stored in the memory in a predetermined order, the first predetermined control sequence being different than a second predetermined control sequence that was previously selected to control generation of non-firing electrical signals for another printed image.

14. The inkjet printer of claim 10, the controller being further configured to:

identify a number of the first plurality of non-firing electrical signals to be applied to the first inkjet in a lookup table stored in the memory using the first number of ink drop ejections as an index to the lookup table; and mask a portion of the first predetermined control sequence that corresponds to generation of non-firing electrical signals that exceed the number of non-firing electrical signals identified in the lookup table to generate the first control data.

15. The inkjet printer of claim 10, the actuator in the first inkjet further comprising a piezoelectric actuator.

* * * * *